US009798273B2

(12) United States Patent
Wu

(10) Patent No.: US 9,798,273 B2
(45) Date of Patent: Oct. 24, 2017

(54) ENDLESS FUSER BELT WITH HEAT PIPE AND TWO HEATING ELEMENTS

(71) Applicant: Lexmark International, Inc., Lexington, KY (US)

(72) Inventor: Fangsheng Wu, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/414,669

(22) Filed: Jan. 25, 2017

(65) Prior Publication Data

US 2017/0277088 A1 Sep. 28, 2017

Related U.S. Application Data

(63) Continuation of application No. 15/081,518, filed on Mar. 25, 2016, now Pat. No. 9,665,047.

(51) Int. Cl.
*G03G 15/20* (2006.01)

(52) U.S. Cl.
CPC ..... *G03G 15/2017* (2013.01); *G03G 15/205* (2013.01); *G03G 15/2053* (2013.01); *G03G 2215/2041* (2013.01)

(58) Field of Classification Search
CPC ..... G03G 15/2017; G03G 15/2039; G03G 15/205; G03G 15/2053; G03G 15/2064; G03G 15/2078; G03G 2215/2016; G03G 2215/2032; G03G 2215/2041; G03G 2215/2045
USPC ..... 399/69, 70, 329; 219/216
See application file for complete search history.

(56) References Cited

U.S. PATENT DOCUMENTS

| | | | | |
|---|---|---|---|---|
| 8,139,992 | B2 * | 3/2012 | Pirwitz | G03G 15/2064 399/122 |
| 2005/0078990 | A1 * | 4/2005 | Shiraishi | G03G 15/2042 399/329 |
| 2007/0000899 | A1 * | 1/2007 | Tsunoda | G03G 15/2039 219/216 |
| 2008/0181623 | A1 * | 7/2008 | Hasegawa | G03G 15/5004 399/13 |
| 2009/0092424 | A1 * | 4/2009 | Kim | G03G 15/2064 399/329 |
| 2010/0098468 | A1 * | 4/2010 | Lee | G03G 15/2053 399/329 |

(Continued)

FOREIGN PATENT DOCUMENTS

| | | | |
|---|---|---|---|
| JP | 05210336 | A * | 8/1993 |
| JP | 2001201963 | A * | 7/2001 |

(Continued)

*Primary Examiner* — Robert Beatty

(57) ABSTRACT

A fuser assembly comprising an endless fuser belt having positioned internally within a first metal roll having a heat pipe, a second metal roll having a first heating element, and a second heating element disposed between the first and the second metal rolls. The endless fuser belt is disposed proximate to a backup roll for forming a fusing nip therewith, wherein a rotation of the backup roll moves the fuser belt and rotates the first and the second metal rolls. The second metal roll is positioned upstream of the first metal roll relative to a media process direction. The first heating element has a rated heating power greater than the rated heating power of the second heating element.

8 Claims, 4 Drawing Sheets

(56) References Cited

U.S. PATENT DOCUMENTS

| | | | | |
|---|---|---|---|---|
| 2010/0150624 | A1* | 6/2010 | Yamamoto | G03G 15/2053 399/329 |
| 2010/0178071 | A1* | 7/2010 | Barton | G03G 15/2039 399/69 |
| 2011/0070006 | A1* | 3/2011 | Sone | G03G 15/2039 399/333 |
| 2014/0369725 | A1* | 12/2014 | Bayerle | G03G 15/2053 399/329 |
| 2016/0033914 | A1* | 2/2016 | Momma | H01L 27/14625 399/33 |

FOREIGN PATENT DOCUMENTS

| | | | |
|---|---|---|---|
| JP | 2006308932 | A | * 11/2006 |
| JP | 2012220862 | A | * 11/2012 |

* cited by examiner

ENDLESS FUSER BELT WITH HEAT PIPE AND TWO HEATING ELEMENTS

CROSS REFERENCES TO RELATED APPLICATIONS

This application claims priority as a continuation of U.S. patent application Ser. No. 15/081,518, filed Mar. 25, 2016.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to fuser designs, and more particularly to an endless fuser belt assembly having two metal rolls and two heating elements.

2. Description of the Related Art

In an electrophotographic image forming device such as printers and copiers, toner is applied and developed to form a toned image. A fuser assembly in the apparatus then adheres the toned image to a surface of a media such as paper. Fusing methods may be in the form of a radiant fusing, convection fusing, and contact fusing. The most common form of which is contact fusing, which involves two fusing members pressed against each other to form a fusing nip, with one of the fusing members being heated. Heating one of the fusing members may either be in the form of having a heating element disposed on an inner portion on one of the fusing member or external thereto. Various arrangements of fuser assembly components for adhering toned image to media sheets are widely known in the art.

Common market requirements considered in designing fuser assemblies include fast fusing speed, short warm-up and first print time, good narrow media performance, long life, and low cost. Yet it is often the case that at least one of those requirements may be compromised to meet another.

For example, in order to obtain a fast fusing speed, at least one of these methods may be employed for a belt fuser assembly: (1) make the fuser belt thinner, (2) widen the fusing nip, and (3) apply greater load to the fusing nip. Although a thinner belt may result in shorter warm-up and first print times, the resulting axial heat transfer capability and narrow media performance of is low. In particular, when running narrow media, the portion of the fusing nip where no media passes heats up quickly, oftentimes exceeding the desired fusing temperature of the fuser assembly, which either shortens the lifetime of the fuser belt and/or the backup roll or requires lower fusing speeds.

In an alternative design where the fuser assembly components are enlarged to achieve a larger fusing nip region, the speed to which the fuser belt operates may be relatively faster. Yet, increasing the size of the fusing nip also increases the warm-up time and first copy time, the thermal mass of the system, and the size of the whole fuser assembly, which is undesirable. In yet another design, applying greater load to the fusing nip may translate to faster fusing speed. However, more robust components are required such that manufacturing costs for the fuser assembly are increased.

SUMMARY

According to an example embodiment, there is disclosed a fuser assembly including a first metal roll having a heat pipe disposed therein; a second metal roll having a first heating element disposed therein which has a first rated heating power; an endless fuser belt, the first and second metal rolls positioned within the fuser belt for supporting movement thereof in an endless path; a second heating element having a second rated heating power and disposed between the first and the second metal rolls; and a backup roll disposed proximate to the fuser belt for forming a fusing nip therewith, wherein rotation of the backup roll moves the fuser belt and rotates the first metal roll and the second metal roll.

In an example embodiment, the first rated heating power of the first heating element is greater than the second rated heating power of the second heating element. In one aspect, a distance between the first metal roll and the second metal roll along the backup roll defines the width of the fusing nip and the second metal roll is positioned upstream of the first metal roll relative to a media process direction through the fuser assembly, for effectively fusing media at an entrance of the fusing nip and evenly distributing excess heat along an exit portion thereof.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
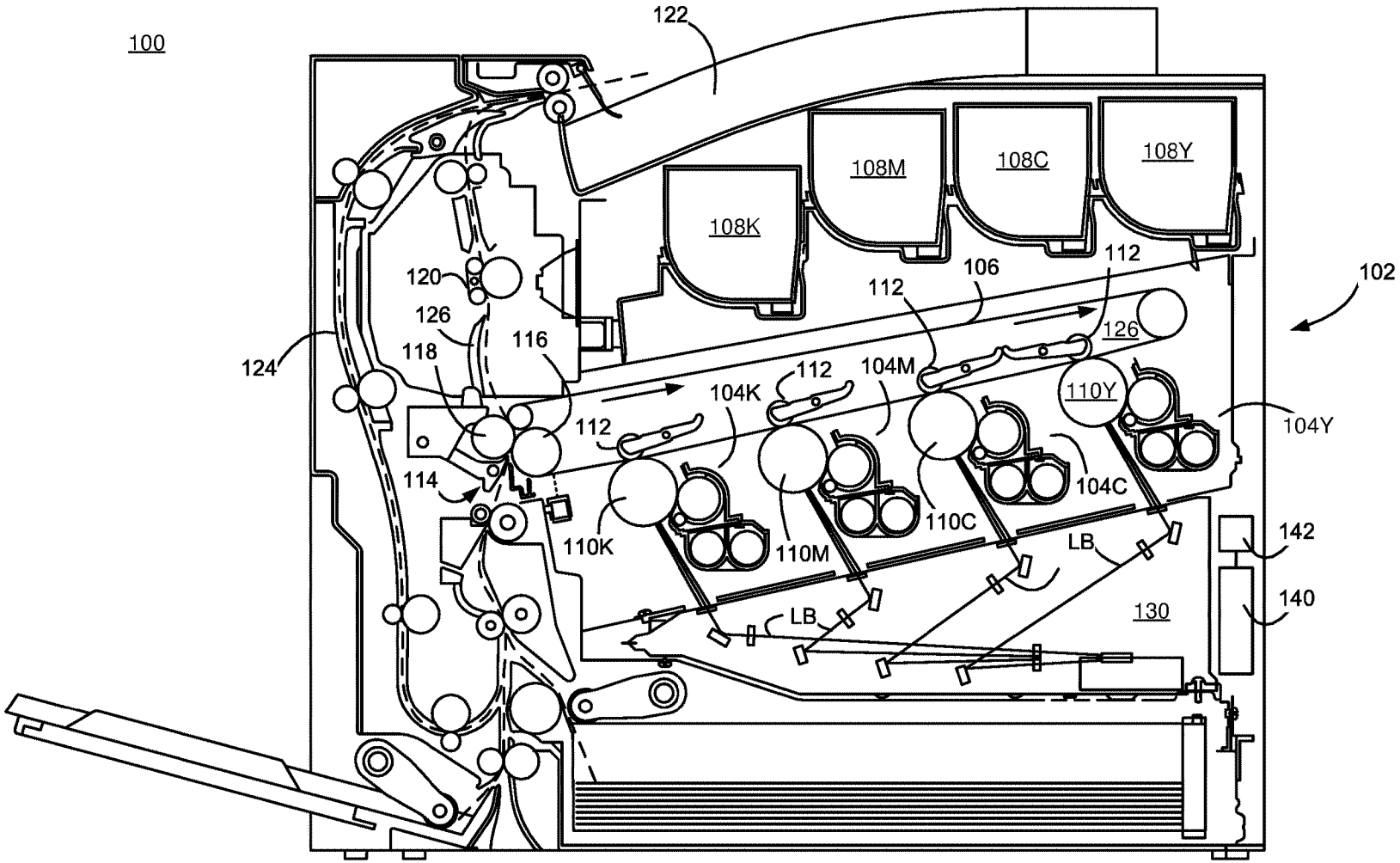
FIG. 1 is a side view of a color image forming device with a fuser belt assembly according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and positionings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color image forming device 100 according to an example embodiment. Image forming device 100 includes a first transfer area 102 having four developer units 104 that substantially extend from one end of image forming device 100 to an opposed end thereof. Developer units 104 are disposed along an intermediate transfer member (ITM) belt 106. Each developer unit 104 holds a different color toner. Developer units 104 may be aligned in order relative to the direction of ITM belt 106 indicated by the arrows in FIG. 1, with the yellow developer unit 104Y being the most upstream, followed by cyan developer 104C, magenta developer unit 104M, and black developer unit 104K being the most downstream along ITM belt 106.

Each developer unit 104 is operably connected to a toner reservoir 108 for receiving toner for use in an imaging operation. Each toner reservoir 108 is controlled to supply toner as needed to its corresponding developer unit 104. Each developer unit 104 is associated with a photoconductive member 110 that receives toner therefrom during toner development to form a toned image thereon. Each photoconductive member 110 is paired with a transfer member 112 for use in transferring toner to ITM belt 106 at first transfer area 102.

During color image formation, the surface of each photoconductive member 110 is charged to a specified voltage, such as −800 volts, for example. At least one laser beam LB from a printhead 130 is directed to the surface of each photoconductive member 110 and discharges those areas it contacts to form a latent image thereon. In one example embodiment, areas on the photoconductive member 110 illuminated by the laser beam LB are discharged to approximately −100 volts. Each of developer units 104 then transfers toner to its corresponding photoconductive member 110 to form a toner image thereon. The toner is attracted to the areas of the surface of photoconductive member 110 that are discharged by the laser beam LB from the printhead 130.

ITM belt 106 is disposed adjacent to each developer unit 104. In this example embodiment, ITM belt 106 is formed as an endless belt disposed about a drive roll and other rolls. During image forming operations, ITM belt 106 moves past photoconductive members 110 in a clockwise direction as viewed in FIG. 1. One or more of photoconductive members 110 applies its toner image in its respective color to ITM belt 106. For mono-color images, a toner image is applied from a single photoconductive member 110K. For multi-color images, toner images are applied from two or more photoconductive members 110. In one example embodiment, a positive voltage field formed in part by transfer member 112 attracts the toner image from the associated photoconductive member 110 to the surface of moving ITM belt 106.

ITM belt 106 rotates and collects the one or more toner images from the one or more developer units 104 and then conveys the one or more toner images to a media sheet at a second transfer area 114. Second transfer area 114 includes a second transfer nip formed between at least one backup roll 116 and a second transfer roll 118.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Figure 2A:
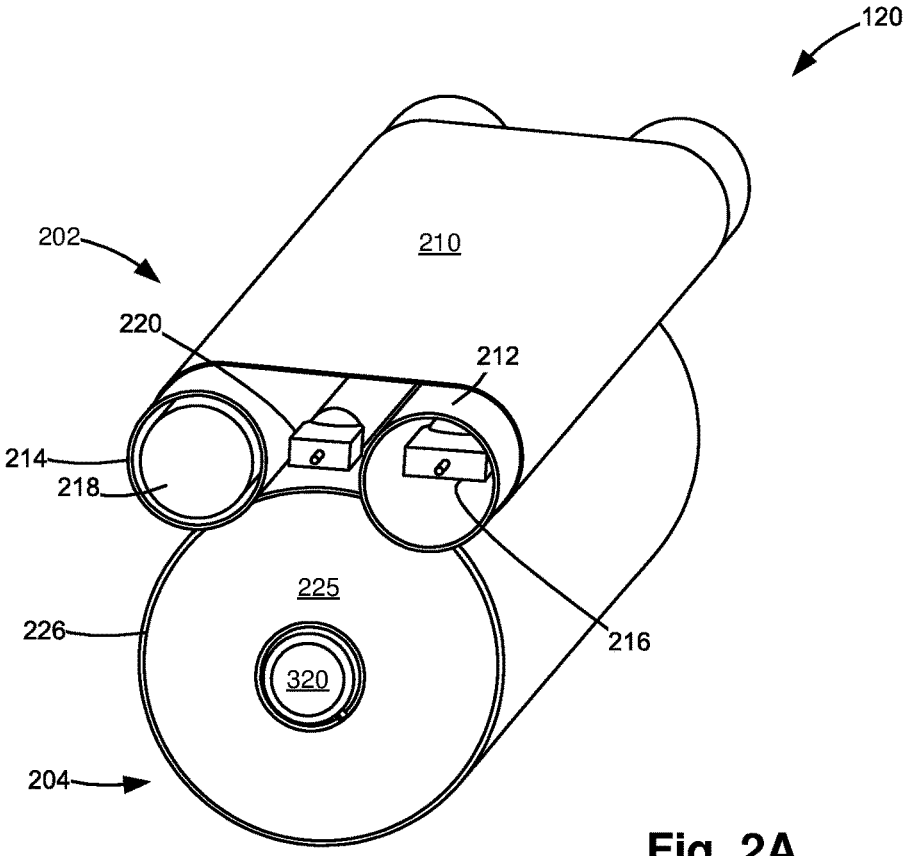
FIGS. 2A and 2B are perspective and side cross-sectional views of the fuser belt assembly shown in FIG. 1, respectively.
Figure 2B:
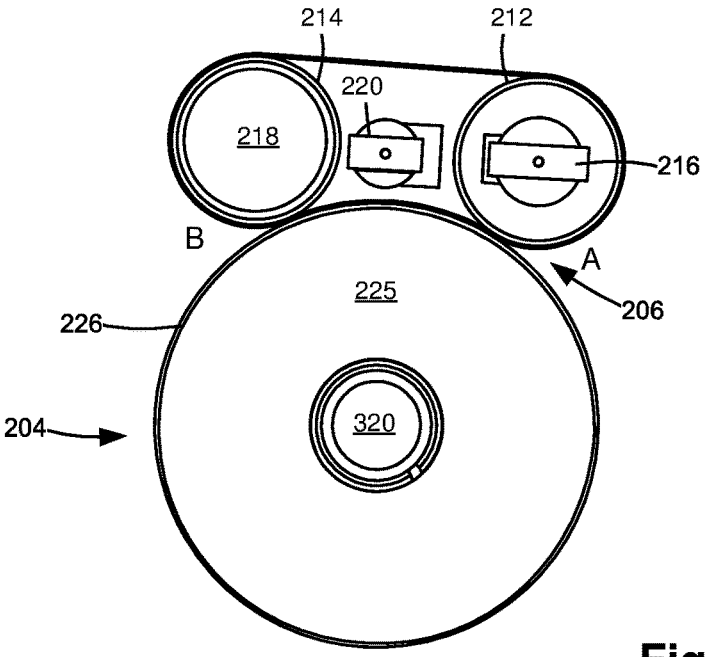

With respect to FIGS. 2A and 2B, fuser assembly 120 includes a heating assembly 202 and a backup roll 204 cooperating with the heating assembly 202 to define a fusing nip region 206 through which a media sheet passes so as to fuse toner material to the media sheet during a fusing operation. A media entry guide 126 (FIG. 1) is provided just upstream of the fuser assembly 120 for guiding the media sheet into the fusing nip region 206.

Backup roll 204 includes a metal core 225 and one or more layers 226. The one or more layers 226 includes rubber may have a thickness between about 2 mm and about 3 mm constructed using, for example, liquid injection molding, foam, or microballoons. One or more layers 226 may also include an outer PFA (polyperfluoroalkoxy-tetrafluoroethylene) sleeve or layer provided on backup roll 204 that is between about 40 microns and about 50 microns thick. Backup roll 204 may have an outer diameter between about 30 mm and about 50 mm, such as 40 mm. Backup roll 204 includes a shaft 320.

As shown in FIGS. 2A and 2B, heating assembly 202 includes a belt 210 and a pair of nip forming rolls 212, 214 positioned internally within fuser belt 210 for supporting movement thereof in an endless path. Belt 210, with nip forming rolls 212, 214, are positioned relative to the backup roll 204 to provide a pressing force to a section of an outer surface of the belt to form fusing nip region 206 therewith. In one example embodiment, backup roll 204 may be driven by a motor (not shown). Rotation of backup roll 206 moves belt 210 and by virtue of their engagement with the belt, rotates nip forming rollers 212, 214. As a result, a media sheet is moved through fusing nip region 206. In another example embodiment, one of nip forming rollers 212, 214 may be driven by the motor such that rotation of the driven nip forming roller 212, 214 moves belt 210 and by virtue of the engagement with the belt, rotates backup roll 204.

Belt 210 may include a polyimide substrate layer having a thickness between 50 microns and about 100 microns, a rubber coating or layer having a thickness between about 200 microns and about 300 microns, such as about 250 microns, and a release coating or layer such as a PFA layer having a thickness between about 20 microns and about 40 microns, such as 30 microns. Belt 210 may have an inner diameter between about 25 mm and about 35 mm, such as about 30 mm.

Nip forming rolls 212, 214 are disposed about an inner surface of belt 210 along opposing portions thereof. A distance between the two along the inner surface of belt 210 defines a width of fusing nip region 206. Nip forming roll 212 is a heat-generating member and is positioned upstream of nip forming roll 214 relative to a media process direction in fuser assembly 120 to effectively fuse toner to the media sheet, as will be discussed in detail below. Nip forming rolls 212, 214 engage backup roll 204 via belt 210 at entrance A and at exit B of fusing nip region 206, respectively (see FIG. 2B). In one example embodiment, nip forming rolls 212, 214 may be substantially the same size. Each of nip forming rolls 212, 214 may have a thickness between about 0.3 mm and about 0.7 mm, such as 0.5 mm.

In having nip forming rolls 212, 214 positioned within belt 210, a wider nip region is formed. Fusing nip region 206 may be between about 16 mm and about 32 mm wide, such as about 24 mm. With fusing nip region 206 being relatively large, fusing speed can be made faster and/or fusing temperature lower.

Nip forming roll 212 includes a heating element 216 disposed therein. Nip forming roll 212 is constructed of metal (e.g., steel) for conducting and transferring heat generated by heating element 216 along an inner surface of belt 210. In one example embodiment, heating element 216 is a lamp operative to generate heat at a first rated heating power. In one example embodiment, the first rated heating power may be between about 600 W and about 1000 W. Nip forming roll 212 may have an outer diameter between about 11 mm and about 15 mm.

Nip forming roll 214 may take the form of a metal roll containing a heat pipe 218. Heat pipe 218 is disposed within nip forming roll 214 for transferring heat from one overly heated portion of fusing nip region 206 to another portion thereof, via thermal conduction through nip forming roll 214. In this way, nip forming roll 214 prevents overheating portions of belt 210 and/or backup roll 204 in fusing nip region 206 which do not contact narrow media. Nip forming roll 214 may have an axial length longer than an axial length of backup roll 204 in order to more effectively transfer excess heat when fusing narrow media. Nip forming roll 214 may have an outer diameter between about 11 mm and about 15 mm. As such, nip forming rolls 212, 214 may be substantially the same size.

Heat pipes are known to transfer heat using thermal conductivity and phase transition. In general terms, heat pipes, and particularly heat pipe 218, may include a vessel in which its inner walls are lined with a wick structure. When the heat pipe is heated at one end, the working fluid therein evaporates and changes phase from liquid to vapor. The vapor travels through the hollow core of the heat pipe to the opposed end thereof, where the vapor condenses back to liquid and releases heat at the same time. The liquid then travels back to the original end of the heat pipe via the wick structure by capillary action and is then available to repeat the heat transfer process. Heat pipe 218 may have an outer diameter slightly less than the inner diameter of nip forming roll 214, such as between about 10 mm and about 14 mm. Heat pipe 218 is thermally conductive with nip forming roll 214.

Figure 3:
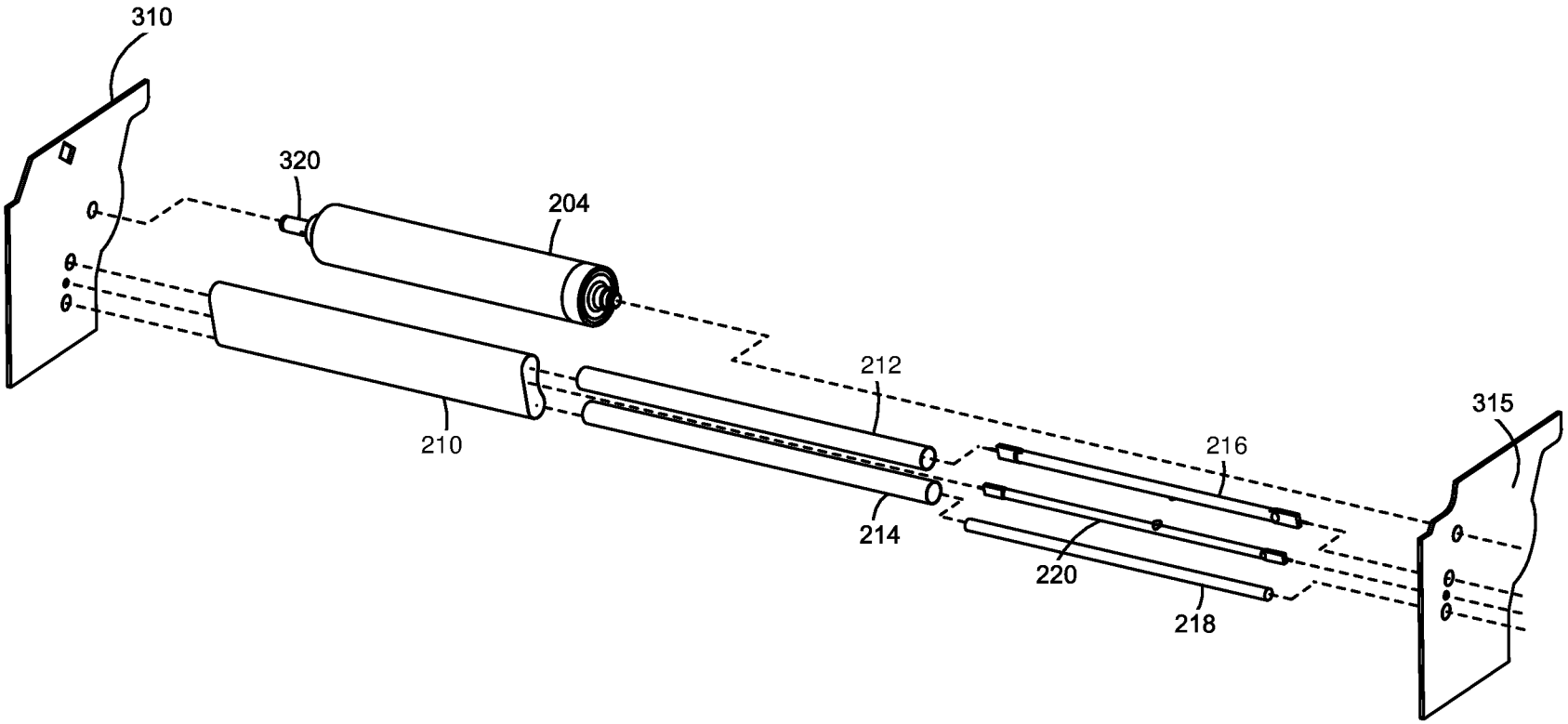
FIG. 3 is an exploded perspective view of the endless fuser belt assembly of FIG. 1 according to an example embodiment.

In addition to nip forming rolls 212, 214, heating assembly 202 further includes a heating element 220. In an example embodiment, heating element 220 may be in the form of a lamp. As shown in FIGS. 2A-2B and FIG. 3, heating element 220 is disposed between nip forming rolls 212, 214.

Heating element 220 is operative to generate heat at a second rated heating power that is less than the first rated heating power of heating element 216 disposed within nip forming roll 212. In one example embodiment, the second rated heating power of heating element 220 is between about 600 W and about 1000 W. A combined rated heating power of both heating elements 216 and 220 may be between about 1400 W and about 1600 W, which is substantially equal to the rated heating power of a typical fuser heater, as is known in the art. Each heating element 216 and 220 may include electrodes or connectors (not shown) for receiving signals from controller 140 (FIG. 1) indicative of an amount of power for and/or an amount of heat to be generated by the heating element.

In part because fusing nip region 206 is wider than the typical fusing nip region in existing fuser belt assemblies, fuser assembly 120 may have a total load of between about 30 pounds and about 60 pounds, and particularly between about 35 pounds and about 50 pounds. Existing contact fuser belt assemblies typically have a total load of between about 75 pounds and about 100 pounds. With fuser assembly 120 having a lower total load relative to existing fuser belt assemblies, the life of fuser belt 210 and backup roll 204 is extended. As a result, relatively thin rubber material may be used for one or more layers 226 of backup roll 204.

As shown in FIG. 3, fuser assembly 120 includes a frame or housing (not shown) having opposing sidewalls 310, 315 to which backup roll 204 and nip forming rolls 214 and 216 are rotatably mounted. Each of backup roll 204 and nip forming rolls 214 and 216 may include or otherwise be associated with bearings or bushings for supporting rotation with relatively little resistance. Heating element 220 is mounted between sidewalls 310 and 315 within an inner portion of belt 210.

The mounting arrangement on heating assembly 202 is a matter of design choice and the configurations shown should not be taken as limiting. More particularly, the precise mounting configurations of heating element 216 relative to nip forming roll 212 and of heating element 220 relative to belt 210 are a matter of design choice. Further, while backup roll 204 may be depicted as a roll, backup roll 204 may be any type of driving component or backup member in typical fusing assemblies.

When fusing a sheet of narrow media, a portion of fusing nip region 206 which does not contact the media sheet can quickly overheat. With nip forming roll 214 being positioned along an inner surface of belt 210 so that heat pipe 218 is thermally coupled to belt 210 and backup roll 204 via nip forming roll 214, excess heat is transferred from the overheated portion to another portion of fusing nip region 206 so as to substantially evenly distribute the excess heat along the inner surface of the belt. In this way, fusing sheets of narrow media may be performed at fusing speeds comparable to speeds for fusing full size sheets of media.

In having two heating elements with different rated heating power levels disposed along an inner surface of belt 210, the warm-up times may be relatively short. In the present disclosure, "warm-up time" refers to the time it takes to warm up fusing nip region 206 to a fusing temperature for performing a fusing operation. Heating elements 216, 220 may be operated independently by controller 140 for heating and maintaining fusing nip region 206 at a desired fusing temperature. In having the heating element with the higher rated power (heating element 216) disposed inside metal nip forming roll 212 and with metal nip forming roll 212 positioned at the entrance of fusing nip 206, toner is effectively fused to the media sheet. In having the heating element with the lower rated heating power (heating element 220) in the middle portion of belt 210 and the heat pipe at the exit of fusing nip region 206, excess heat is substantially evenly distributed throughout fusing nip region 206. Depending upon a desired or required heating temperature and/or fusing speed for the fusing assembly, controller 140 may operate either one of heating elements 216, 220, or both at the same instance. Additionally, each of heating elements 216, 220 may be controlled to generate heat at or below its corresponding rated heating power.

Figure 4:
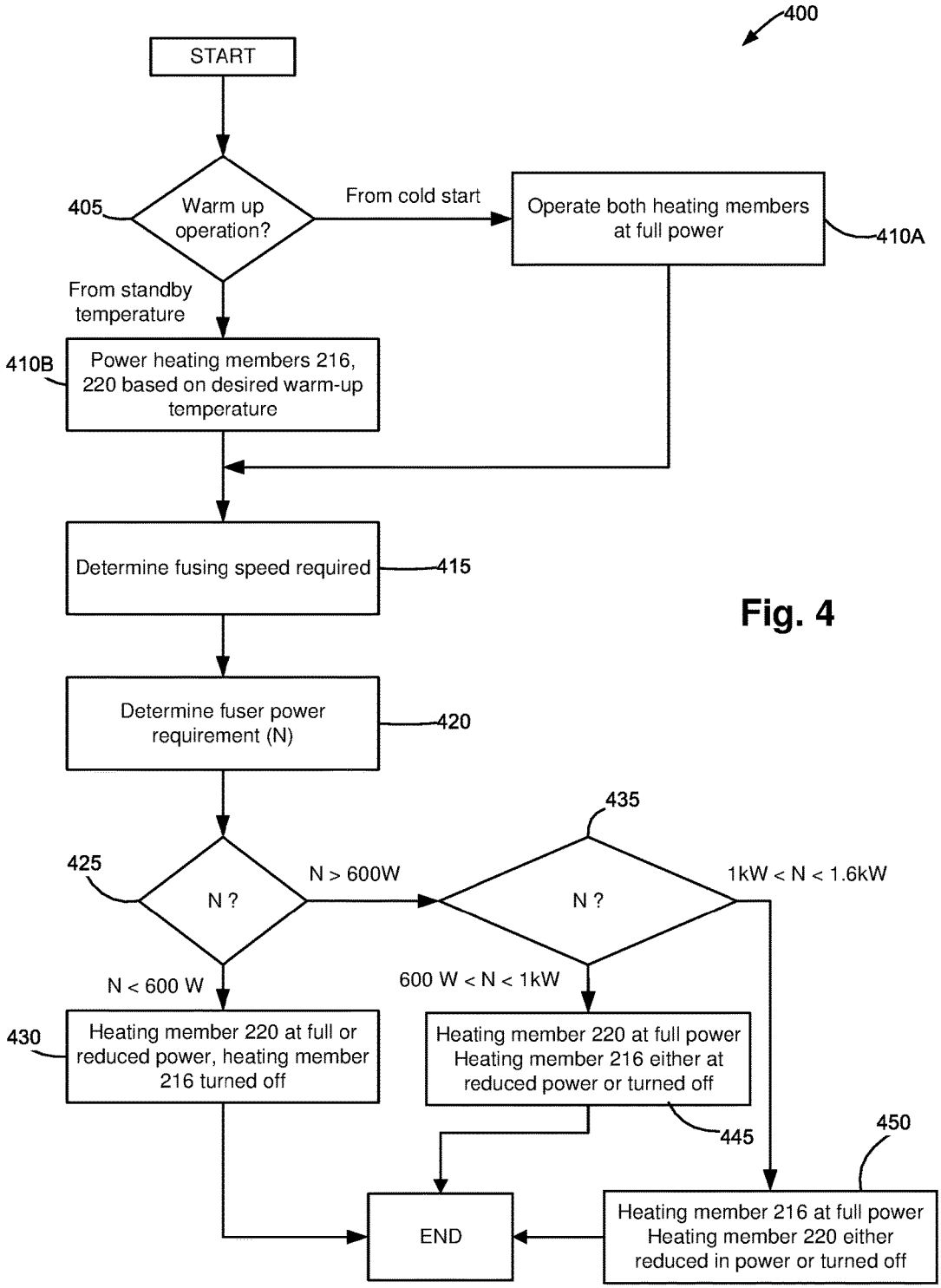
FIG. 4 is a flowchart of an example algorithm for controlling heating power in the fuser assembly of FIG. 1 according to an example embodiment.

FIG. 4 is a flowchart of an example algorithm 400 for controlling heating power in the fuser assembly 120. Blocks 405 to 450 of method 400 are performed by controller 140 of image forming device 100. For purposes of discussion, in algorithm 400, the rated heating power for heating elements 220 and 216, are 600 W and 1000 W, respectively. It is understood that rated heating power of heating elements 216 and 220 may be at different power levels.

At block 405, controller 140 determines whether a warm-up operation is to be performed by image forming device 100 and if so, whether or not the warm-up operation is to be performed from cold start (i.e., fuser assembly 120 being at room temperature) or from a predetermined standby temperature. An affirmative determination that a warm-up operation is to be performed typically results from image forming device 100 receiving an instruction from a user to perform a printing operation, and the current temperature (or operating mode, such as a standby mode) is used by controller 140 to determine whether the warm-up operation is from a cold start or from a standby temperature. Upon determination that a warm-up operation is to be performed from cold start, at block 410A both heating elements 216, 220 are operated, as controlled by controller 140, at their respective full rated heating power levels. This may be in order to meet a minimum (or near minimum) time-to-first-print delay. In the alternative, upon a determination that a warm-up operation is to be performed from fuser assembly 120 being at a standby temperature, at block 410B the total power for heating elements 216, 220 to reach the desired fusing temperature may be less than the rated power for each heating element 216, 220. In one aspect, and depending upon the amount of power needed to warm up fuser assembly 120, one of heating elements 216 and 220 may be powered by controller 140 at its corresponding rated heating power and the other at a reduced heating power relative to its corresponding rated heating power.

At block 415, controller 140 determines the fusing speed required for the fusing operation. The fusing speed may be based upon user input, a preprogrammed speed setting for image forming device 100, the type of media, environmental conditions, etc. At block 420, controller 140 determines the total power requirement N for and/or the amount of heat needed from fuser assembly 120 to effectively fuse toner to media following fuser assembly 120 being warmed up. The fuser power determination may be at least partly based upon the determined fusing speed from block 415 and/or one or more of the factors affecting the determination of block 415. It is understood that the order of blocks 415 and 420 may be interchanged or may be performed simultaneously. Further, blocks 415 and 420 may be performed prior to blocks 410A and 410B being performed.

At this point, controller 140 compares the total fuser power requirement N determined at block 420 with the combined and/or respective rated heating power levels of heating elements 216 and 220.

If the total fuser power requirement N is less than the rated heating power for heating element 220 (block 425), second heater member 220 is controlled at 430 by controller 140 to operate at or below its rated heating power (600 W) and heating element 216 is controlled by controller 140 to be turned off or nearly turned off (block 430).

If the total fuser power requirement N is greater than the rated heating power of heating element 220 but less than the rated heating power of heating element 216 (block 435), then heating element 216 is controlled by controller 140 at block 445 to operate at a power level that is less than the rated heating power thereof while heating element 220 is unpowered. Alternatively, heating element 220 is powered at or near its rated heating power and heating element 216 is powered only occasionally, such as alternating between powered and unpowered states.

If the total fuser power requirement N at block 435 is greater than the rated heating power of heater member 216 and less than the combined rated heating power of heating element 216 and heating element 220, then heating element 216 is controlled by controller 140 at block 450 to operate at or near its rated heating power, and heating element 220 is controlled by controller 140 to be powered at less than its rated heating power, such as occasionally being powered. In another example embodiment, heating element 220 is controlled by controller 140 at block 450 to operate at or near its rated heating power and heating element 216 is controlled by controller 140 to operate at a heating power level that is less than its rated heating power, such as alternating between on and off states.

When a fuser heating element is turned on and off (i.e., powered and unpowered), a sudden current change may occur which may possibly cause the generation of harmonic currents and cause overhead lights that are on the same supply voltage line as image forming device 100 to flicker. It has been observed that the greater the rated heating power of the heating element, the greater the amount of flicker and harmonic current generation. In having two heating elements of different rated heating power levels and controlling the heating elements independently as discussed above such that the heating elements are not turned on and off simultaneously, the amount of flicker and harmonic current generation is reduced.

The description of the details of the example embodiments have been described in the context of a color electrophotographic image forming devices. However, it will be appreciated that the teachings and concepts provided herein are applicable to monochrome electrophotographic image forming devices and multifunction products employing electrophotographic imaging.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A fuser assembly, comprising:

a first metal roll having a first axial length defining a first interior;

a heat pipe disposed in the first interior of the first metal roll;

a second metal roll having a second axial length defining a second interior;

a first heating element disposed in the second interior of the second metal roll;

a fuser belt having an inner surface defining a third interior, the first and the second metal rolls contacting the inner surface of the fuser belt for supporting movement thereof in an endless path; and a second heating element disposed between the first and the second metal rolls in the third interior of the fuser belt, the first and the second heating elements for heating the inner surface of the fuser belt while the heat pipe is configured to transfer away heat from the fuser belt by thermal conduction through the first metal roll, wherein the first and the second heating elements are operative to be powered to a combined total power amount between about 1400 and about 1600 W.

2. The fuser assembly of claim 1, further including a backup roll disposed proximate to an exterior surface of the fuser belt for rolling engagement with the fuser belt to define a fusing nip region having an entrance and exit.

3. The fuser assembly of claim 2, wherein the backup roll has a third axial length and the first and the second axial lengths of the first and the second metal rolls are longer than the third axial length of the backup roll.

4. The fuser assembly of claim 3, wherein the first and second axial lengths of the first and the second metal rolls are substantially the same length.

5. The fuser assembly of claim 1, wherein the first and the second heating elements are configured to be independently operable.

6. The fuser assembly of claim 2, wherein a distance between the first metal roll and the second metal roll along the backup roll defines a width of the fusing nip region, the width being between about 16 mm and about 32 mm.

7. The fuser assembly of claim 2, wherein the second metal roll is positioned nearer the entrance of the fusing nip region than the first metal roll, whereas the first metal roll is positioned nearer the exit of the fusing nip region than the second metal roll.

8. The fuser assembly of claim 1, wherein the heat pipe includes a phase change material.

* * * * *